US009193489B2

(12) United States Patent
Rekieta et al.

(10) Patent No.: US 9,193,489 B2
(45) Date of Patent: Nov. 24, 2015

(54) METHOD OF PROVIDING NON-TWISTED CABLE FROM A STATIONARY BOX

(75) Inventors: Christopher David Rekieta, Inola, OK (US); Michael Leroy Spence, Tulsa, OK (US); Benton F. Baugh, Houston, TX (US)

(73) Assignee: Reel Power Licensing Corp., Oklahoma City, OK (US)

( * ) Notice: Subject to any disclaimer, the term of this patent is extended or adjusted under 35 U.S.C. 154(b) by 1036 days.

(21) Appl. No.: 12/927,032

(22) Filed: Nov. 5, 2010

(65) Prior Publication Data

US 2012/0110955 A1 May 10, 2012

(51) Int. Cl.

| | |
|---|---|
| ***B65H 49/02*** | (2006.01) |
| ***B65H 54/02*** | (2006.01) |
| ***B65B 63/04*** | (2006.01) |
| *B65B 53/02* | (2006.01) |
| *B65H 55/04* | (2006.01) |

(52) U.S. Cl.

CPC ..... *B65B 63/04* (2013.01); *B65H 55/043* (2013.01); *B65H 55/04* (2013.01)

(58) Field of Classification Search

CPC ..... B65H 54/02; B65H 54/01; B65H 19/02; B65H 49/02; B65H 55/04; B65H 55/043; B65H 57/18; B65H 57/28; B65B 17/00; B65B 53/02

USPC ..... 53/430, 118, 235, 582, 442, 116; 57/1, 57/10, 18–19, 58.57, 58.59, 58.79, 58.63, 57/89, 59; 242/18, 167, 177, 178, 472.5, 242/432.6

See application file for complete search history.

(56) References Cited

U.S. PATENT DOCUMENTS

| | | | | |
|---|---|---|---|---|
| 3,688,998 | A * | 9/1972 | Carr et al. | 242/474.4 |
| 4,406,419 | A | 9/1983 | Kotzur | |
| 4,580,399 | A * | 4/1986 | Henrich | 57/59 |
| 5,906,329 | A * | 5/1999 | Wesley, Sr. | 242/390.8 |
| 6,109,005 | A * | 8/2000 | Fogle | 53/430 |
| 6,796,106 | B1 * | 9/2004 | Bulich | 53/430 |
| 6,978,962 | B1 * | 12/2005 | Fore et al. | 242/474.4 |
| 2007/0075171 | A1 * | 4/2007 | Babcock et al. | 242/170 |

* cited by examiner

*Primary Examiner* — Gloria R Weeks
*Assistant Examiner* — Justin Citrin
(74) *Attorney, Agent, or Firm* — Martin G. Ozinga; Phillips Murrah PC

(57) ABSTRACT

The method of supplying non-twisted cable from a non-rotating container comprising supplying a cable to a first spool in a first position by supplying the cable to the first spool in a direction generally parallel to the centerline of the first spool and wrapping the cable around the first spool so that one twist will be applied to the cable with every circumferential wrap, transferring the first spool to a second position without cutting the cable, transferring a second spool to the first position, supplying the cable to a the second spool in the first position by supplying the cable to the second spool in a direction generally parallel to the centerline of the second spool and wrapping the cable around the second spool so that one twist will be applied to the cable with every circumferential wrap, transferring the first spool to a third position and transferring the second spool to the second position, cutting the cable between the second and the third positions, delivering the cable from the third position to be packaged in a container, repeating the process for additional sections of cable to be placed in additional containers, and pulling the cable from the center of the container to untwist the cable as it is being removed from the container.

8 Claims, 17 Drawing Sheets

METHOD OF PROVIDING NON-TWISTED CABLE FROM A STATIONARY BOX

TECHNICAL FIELD

This invention relates to a new and novel package of coiled flexible material that provides for pay out of the coiled flexible material that is twist free from a stationary condition and a method for producing the twist free pay out package of coiled flexible material.

CROSS-REFERENCE TO RELATED APPLICATIONS

Not applicable.

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

When a flexible material comes tangentially off a coil as the coil is rotated, it does not impart a twist to the flexible material. It does provide the disadvantage that the coil must be supported at the center to allow it to turn freely. If the flexible material is removed from the coil without rotating the coil (i.e. laying a coil flat on the floor and pulling the wire straight up), a twist will be imparted to the flexible material making it difficult to handle, making it likely to tangle, and increasing the possibility of damage to the flexible material.

In some cases, the amount of twist can have undesirable effects on the electrical characteristics of the wire. It is desirable to have the flexible material shipped and stored in a container from which it can be removed without adding a twist and also without rotating the container.

The most conventional method of providing cable from a package which is not twisted is to provide a rotating spool within a corrugated box and pulling the cable hard enough to cause the spool to rotate. High friction, jamming, and high required pulls make this a less than satisfactory solution in many applications.

It is well known in the prior art to provide a package of coiled flexible material that provides for pay out of the coiled flexible material that is twist free from a stationary condition and to provide methods for producing these packages of coiled flexible materials. The prior art discloses a package of flexible material formed from a number of figure-eight type coils where various means are used to provide an opening to the center of the package through which the end of the flexible material is led out in order to allow the flexible material to pay out by this end of the flexible material for twist free pay out. The external shape of the prior art can be spherical, elongated spherical, funnel or cylindrical. The various means of providing an opening to the center of the figure-eight type coil for the end of the flexible material to be led out through include: (1) an axial opening in the package that is formed during the process of manufacturing the package of flexible material; (2) an opening formed from a plurality of conical members that the figure-eight coils are wound around; (3) an opening formed by a circular tube inserted into the package of flexible material; (4) an opening formed by the combination of a circular tube connected to a funnel wherein the funnel acts as a guide for the flexible material as it is pulled to center of the package; (5) an opening formed by an oval shaped tube inserted into the package of flexible material.

For example, the REELEX (a trademark of Windings, Inc) system of coiling, which consists of winding figure-eight coils of filamentary material distributed radially around a mandrel and providing a radial hole extending from the inner coil to the outer coil and through which the coiled filamentary material is to be withdrawn (see U.S. Pat. No. 4,406,419). This prior art allows twist free pay out if the filamentary material has little or no inherent twist in it. However, if the filamentary material has inherent twist, the pay out will not be twist free because the loops of the figure-eights must be free to compensate for one another, thereby canceling the twist caused by each other. If this compensation does not occur, then loops that contain the twist will come free of the pay out tube winding wall and cause tangles. This occurs when winding coils, with the twist, lay very close together. The prior art also teaches a solution to the REELEX problem of having a twist in impeding pay out by receiving the figure-eight coils of flexible material in a box containing a large pay out hole and large tube for allowing the inner end of the flexible material to be led out through the large tube and large pay out hole where the pay out hole is either a diamond or an oval shape. The size of the pay out hole must be large enough to allow the twists to exit the pay out hole and tube. While this allows the filamentary material to be withdrawn form the package, it does not eliminate the twists in the filamentary material. The packages with figure-eight coils are limited to small materials that can fold over on itself inside the center of the coil. These packages have low package density and can cause damage to the flexible material because the flexible material has to fold over itself to unwind from the center of the package. Various methods for producing the above discussed packages have been disclosed in the prior art. In particular, is the patent issued to Henrich (U.S. Pat. No. 4,580,399 dated Apr. 8, 1986), which is directed to a method of winding flexible material onto a spool in a series of coils where the end of the flexible material is reversed from the direction of winding the coils so that the flexible material is led out of the spool so that the flexible material can be subjected to further processing. The above prior art has not solved the problem of twist free pay out of materials in a stationary condition that could be used in every day construction and allows the flexible material to twist prior to leaving the package and causes tangles of the flexible material within the package.

Therefore, there is a need in the art for a package of coiled flexible material that provides for pay out of the coiled flexible material that is twist free from a stationary condition and a method for producing the twist free pay out package of coiled flexible material using a non-figure-eight coil where the flexible material is unwound on the axis perpendicular to the coil of the flexible material such that the unwinding of the flexible material in this direction imposes a twist in the flexible material that is opposite the twist imparted in the flexible material when coiled into said package whereby both twists neutralize each other and the flexible material is removed from said package of flexible material twist free.

BRIEF SUMMARY OF THE INVENTION

The object of this invention is to provide a coil of cable which allows the cable to be removed from a stationary coil without having a twist in the cable.

A second object of this invention is to provide a means for wrapping a cable in a bundle with a twist applied such that it cancels out a twist which naturally occurs when the cable is pulled from the center of the bundle.

A third object of this invention is to provide a means for automating the wrapping of multiple coils of a cable by having the cable remaining connected to a coil until the cable is wrapped onto the next coil.

Another object of the present invention is to provide means for automating the wrapping of coils of a cable by having packaging side plates of a different internal diameter such that they can be separated by internal diameter to opposite sides of the coil to be wrapped.

DETAILED DESCRIPTION OF THE INVENTION

Figure 1:
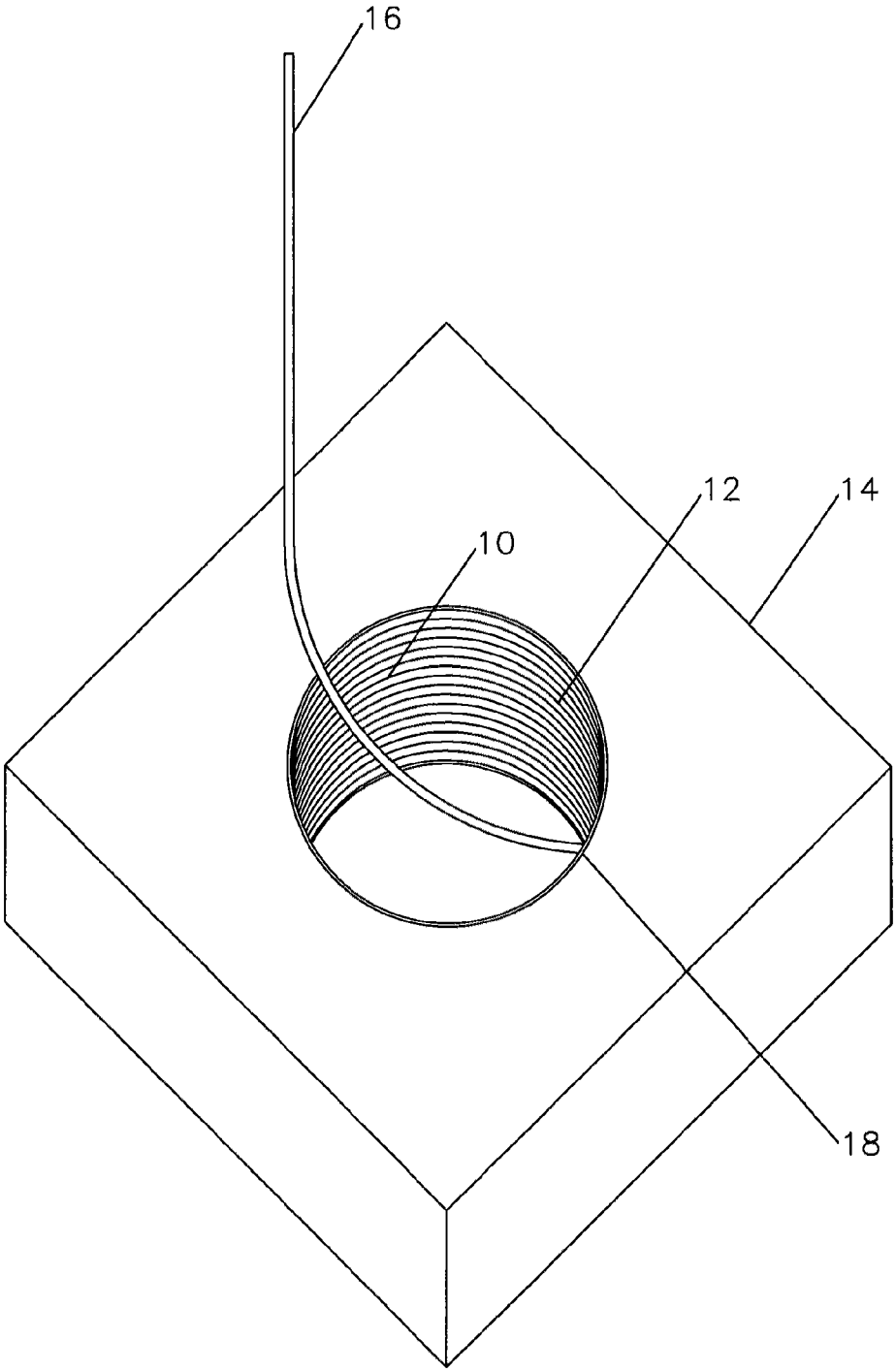
FIG. 1 is a perspective of a box of cable of this invention with the wire being pulled out from a central hole without being twisted.

Referring to FIG. 1, a coil 10 of cable 12 is shown inside a box 14 with end 16 being pulled out hole 18 of box 14. The cable can be of a wide variety of materials including single strand of wire, multiple wires, fiber optic tubes, tubing, etc. If the cable is wrapped into the coil 10 by conventional means, when end 16 is pulled out, the cable will have a twist in it. For each circumference of cable 12 pulled out of box 14, a full twist will be imparted to the cable 12. A cable 12 pulled out of box 14 when wrapped on the coil by the present invention will not have a twist in it.

Figure 2:
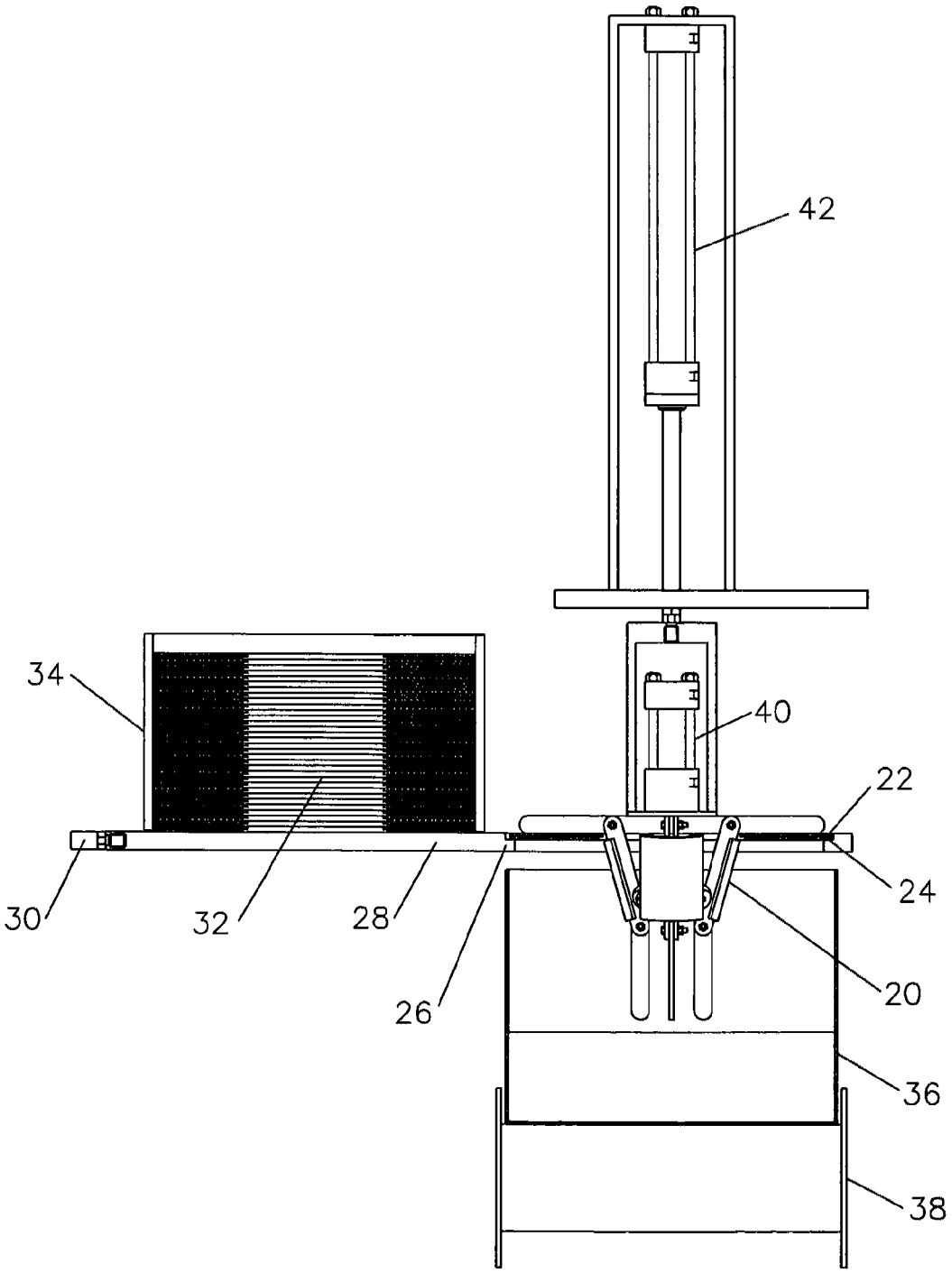
FIG. 2 is a partial section of a collapsible coiling head engaging side plates in preparation for a wrapping.

Referring now to FIG. 2, a portion of the apparatus for this invention is shown. Collapsible coiling head 20 is shown going through central holes in upper side 22 and lower side 24 of the packaging of the coil to be formed. Upper side plate 22 and lower side plate 24 are in recess 26 of slider 28. A motive means such as an air cylinder shown at 30 is connected to slider 28 to move the slider between the present position and a position such that recess 26 is below the supply of side plates 32 contained within cylinder 34. When the side plates shown in recess 26 are removed during the process, slider 28 moves to the alternate position and receives a new pair of side plates for the next coil to be formed.

Box 36 is one of a series of such boxes on conveyor belt 38 adapted to receive the finished coils of cable for shipment. Cylinder 40 is adapted to engage and disengage the collapsible coiling head 20. Cylinder 42 is adapted to raise and lower the collapsible coiling head 20 during operations.

Figure 3:
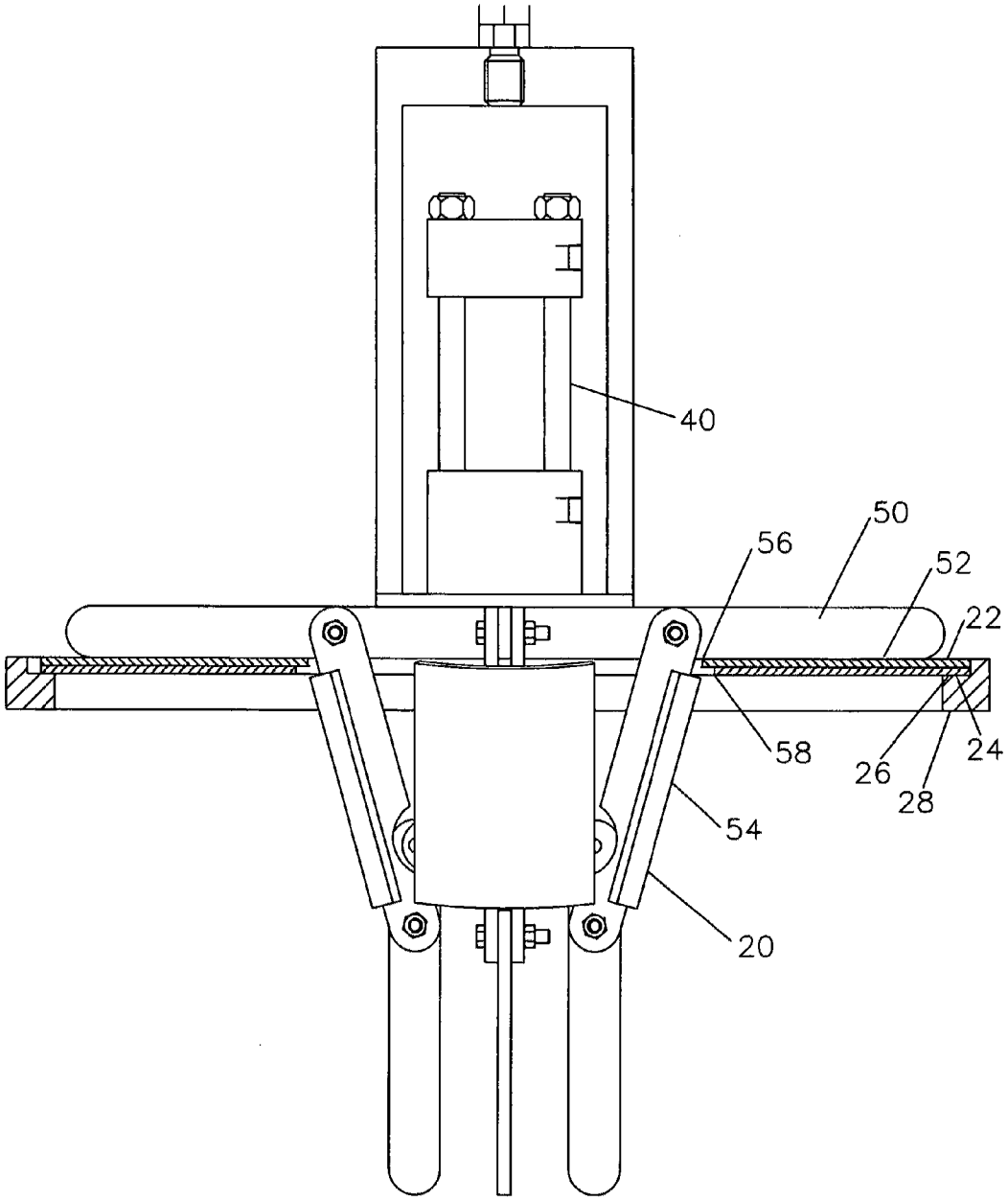
FIG. 3 is a close up view of a portion of FIG. 2 showing more clearly the relationship of the collapsible coiling head and the side plates.

Referring now to FIG. 3, it can be seen that arms 50 of the collapsible coiling head 20 are adapted to land on the upper surface 52 of the upper side plate 22. The lower portion 54 of collapsible coiling head 20 is adapted to pass through the internal diameter 56 of upper side plate 22 and the larger internal diameter 58 of lower side plate 24.

Figure 4:
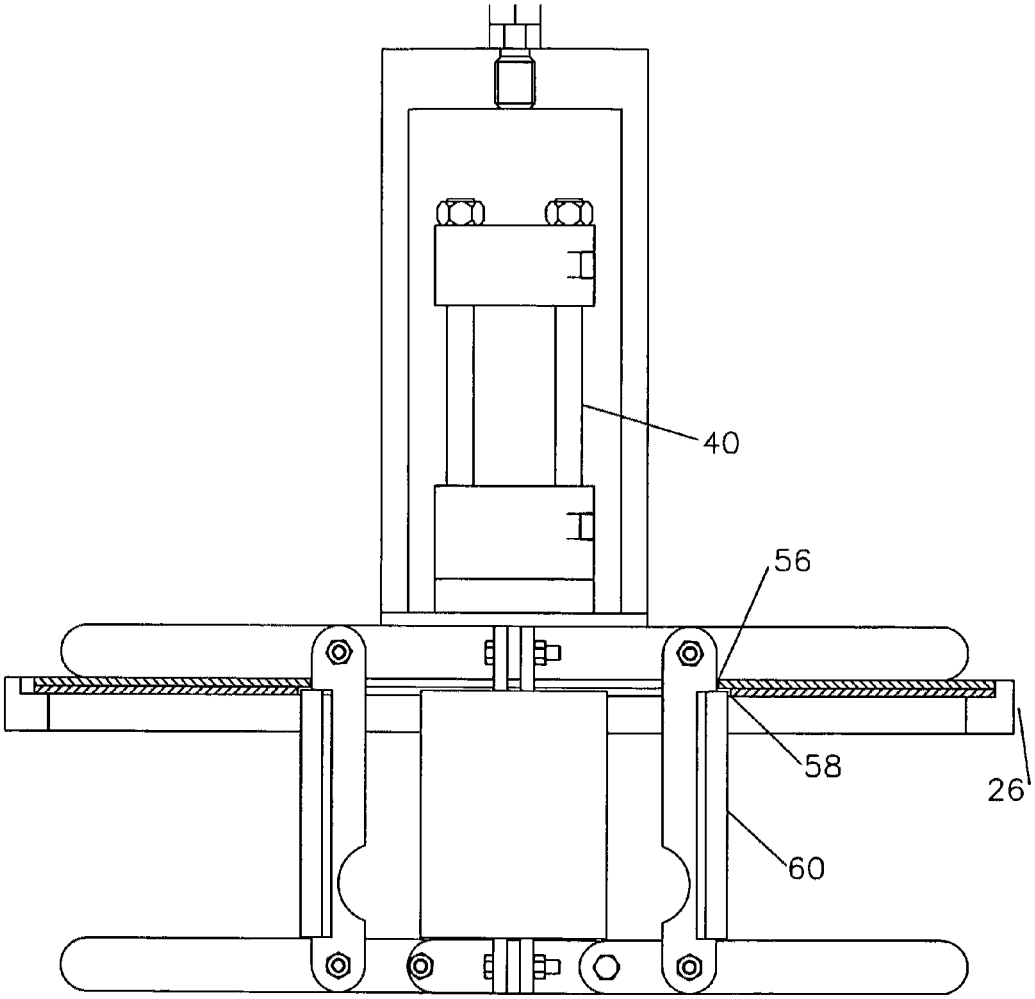
FIG. 4 is a view of the collapsible coiling head in the engaged position.

Referring now to FIG. 4, the cylinder 40 has actuated the collapsible coiling head 20 to an engage position. It will be noted that pads 60 expand to a diameter larger than internal diameter 56 but not as large as internal diameter 58.

Figure 5:
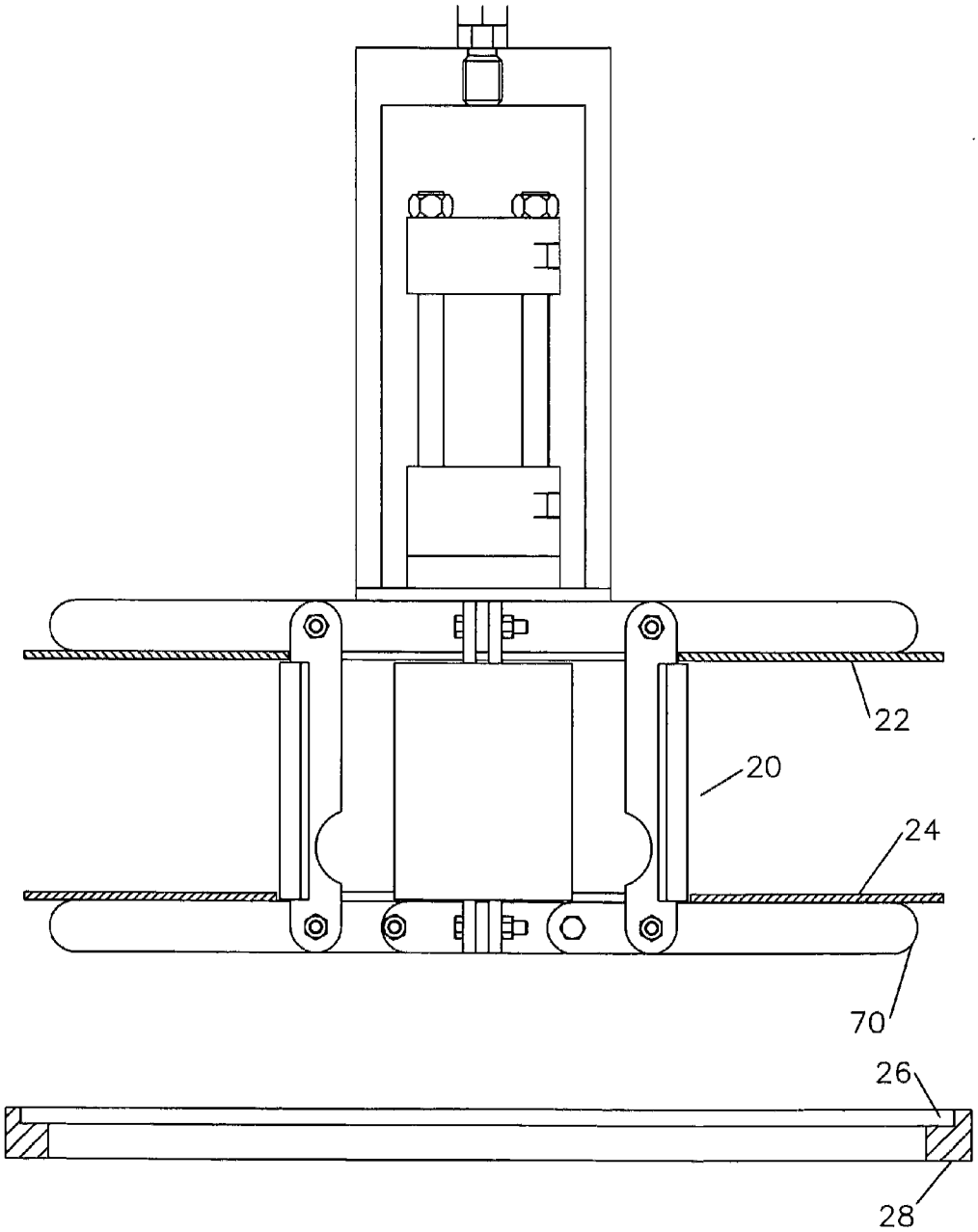
FIG. 5 is a view of the collapsible coiling head in the engaged and raised position, allowing the side plates to separate.

Referring now to FIG. 5, when the collapsible coiling head 20 and the side plates are raised above the recess 26 of slider 28, the upper side plate 22 remains in the same position but the lower side plate 24 falls to land on lower arms 70. The side plates are now positioned to receive the cable to be wrapped.

Figure 6:
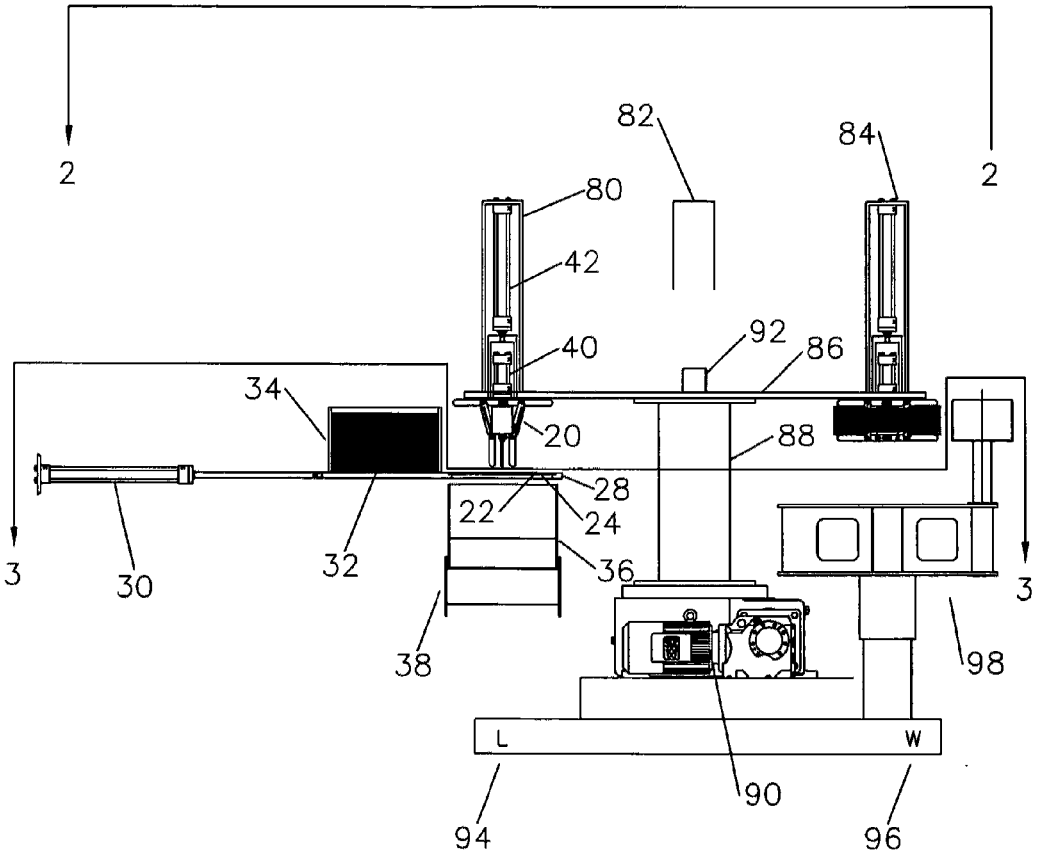
FIG. 6 is a view of the system showing the loading station and the wrapping station with the collapsible coiling head in the loading station in the raised position.

Referring now to FIG. 6, various parts as described in previous figures are shown in a starting position with the collapsible coiling head 20 above the slider 28, without having engaged the side plates 22 and 24. There are 3 identical operating stations 80, 82, and 84 which are mounted on a rotating plate 86 above column 88 and rotated by motor and gear assembly 90. Swivel 92 will conduct a supply of air to valves (not shown) on the cylinders to power the operations. Ideally the valves will be operated by radio control to eliminate needing to send multiple signals to a rotating assembly, but electric, air, or hydraulic swivels can be used if preferred. Weld letters 94 and 96 generally indicate that the station on the left hand side of the drawing is a loading station and the station on the right is a wrapping station. The wrapping station 98 will be discussed later in FIG. 15.

Figure 7:
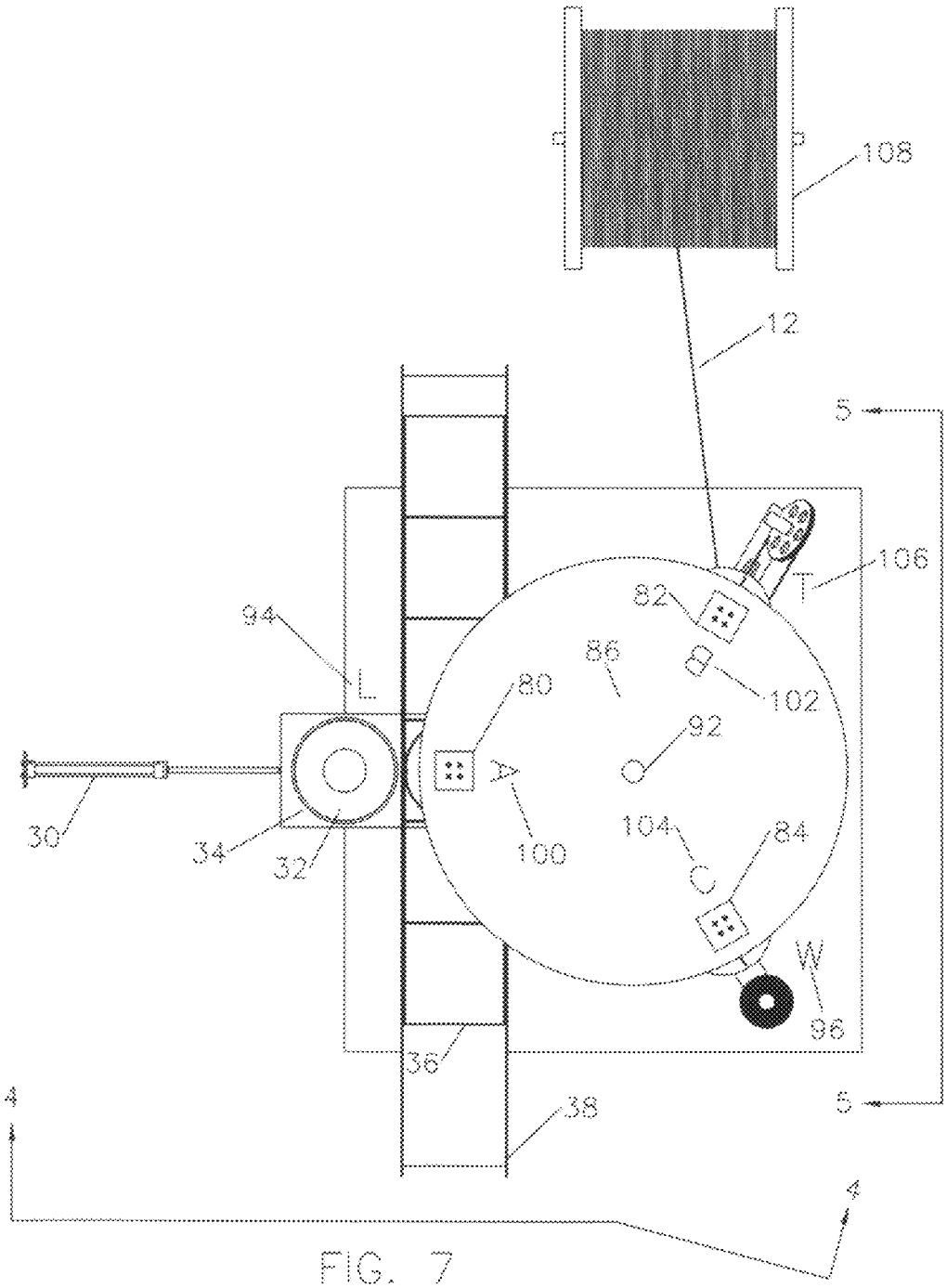
FIG. 7 is a top view of the system.

Referring now to FIG. 7 which is taken along view lines "2-2" of FIG. 6, a top view of the system is shown. The three operating stations 80, 82, and 84 are seen on rotating plate 86 along with swivel 92. Weld letters 100, 102, and 104 generally indicate the three stations for ease of watching and recording the operations. Weld letters 94, 96, and 106 identify the loading, wrapping, and twisting stations respectively. Spool 108 contains the supply of cable 12 to be wrapped onto the collapsible coiling head 20 and placed in boxes 36.

Figure 8:
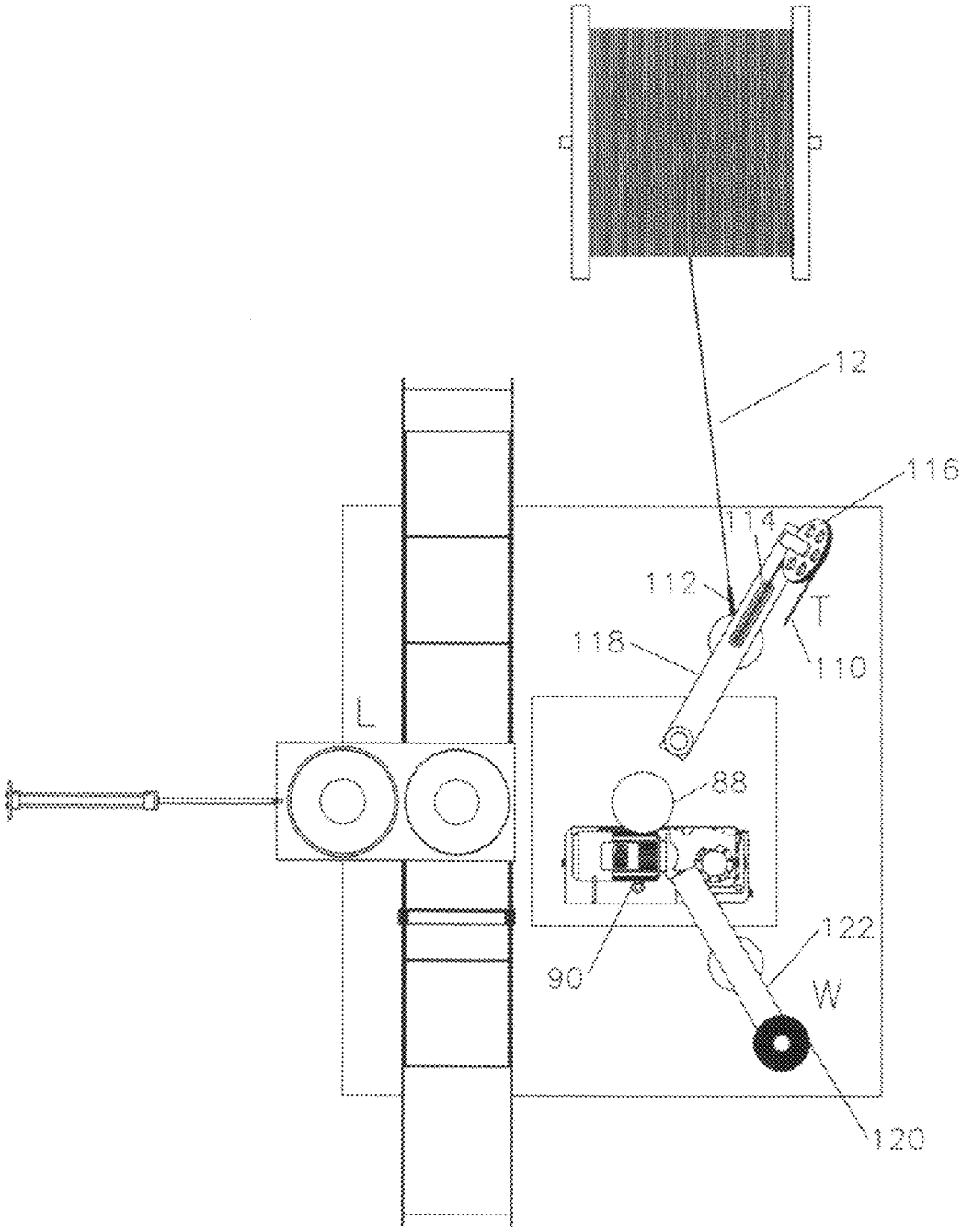
FIG. 8 is a top section of the system with the upper parts removed for clarity.

Referring now to FIG. 8 which is taken along section lines "3-3" of FIG. 6, which removes the upper parts for clarity. The path of cable 12 to end 110 where it will be wrapped onto a collapsible coiling head 20 (not shown) is shown going around sheaves 112, 114, and 116. Sheaves 114 and 116 are mounted on flyer 118, causing sheave 116 to orbit around a collapsible coiling head 20 (not shown). Similarly a coil of wrapping material 120 is mounted on flyer 122 causing the coil of wrapping material to orbit around a collapsible coiling head 20 (not shown) as the coil of cable is being wrapped.

Figure 9:
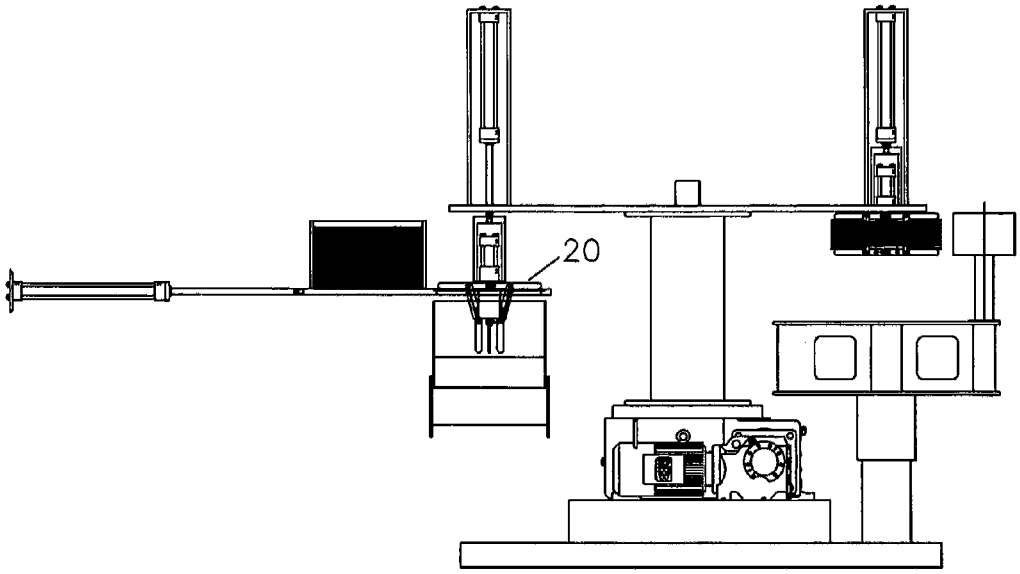
FIG. 9 is a view similar to FIG. 6, with the collapsible coiling head lowered.

Referring now to FIG. 9, collapsible coiling head 20 has been lowered to the position as was shown in FIGS. 2 and 3.

Figure 10:
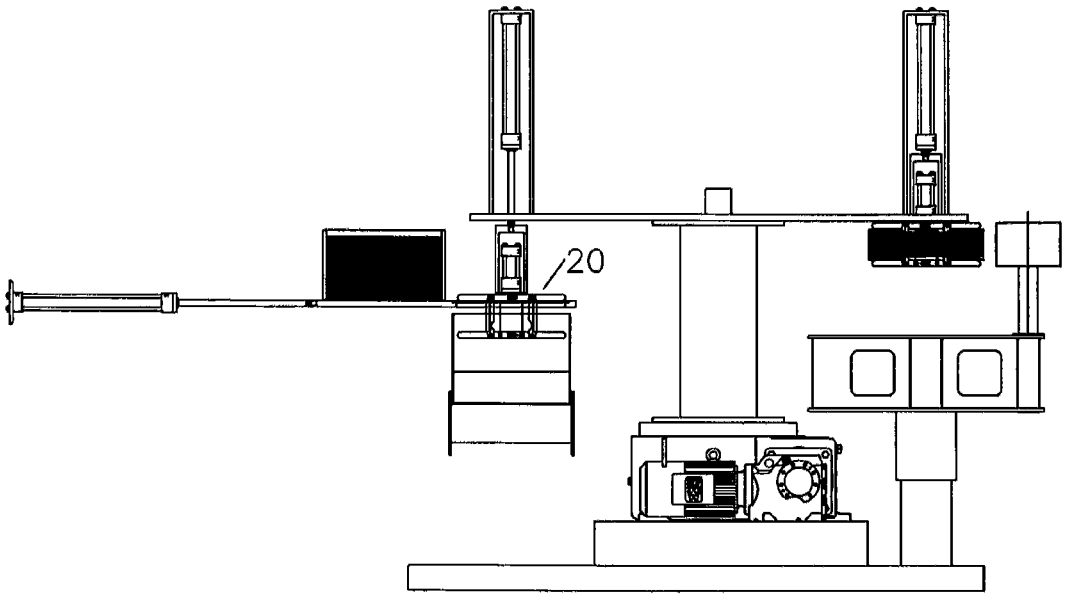
FIG. 10 is a view similar to FIG. 9 with the collapsible coiling head engaged.

Referring now to FIG. 10, collapsible coiling head 20 has been engaged as was shown in FIG. 4.

Figure 11:
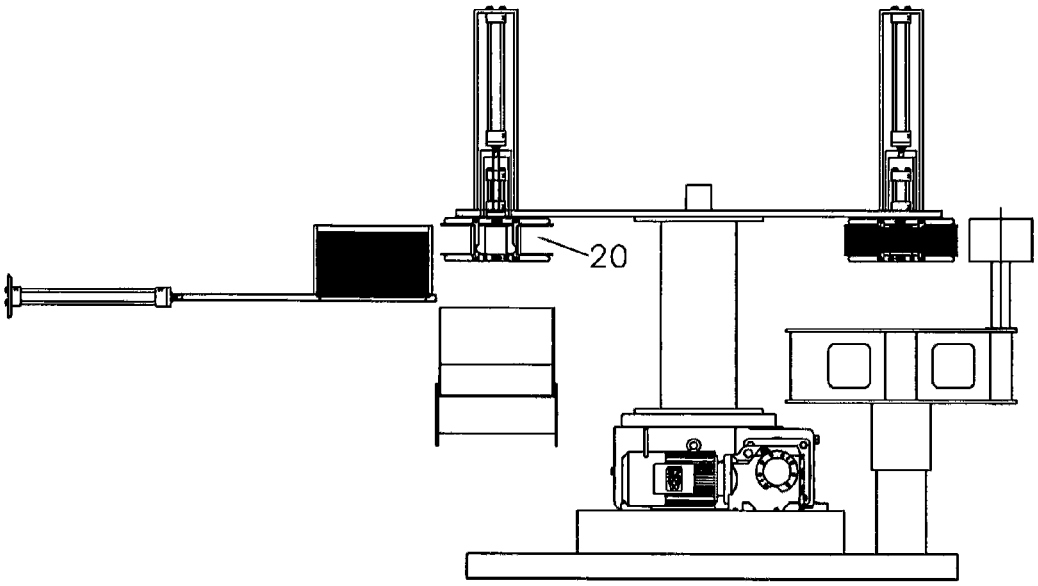
FIG. 11 is a view similar to FIG. 10 with the collapsible coiling head raised.

Referring now to FIG. 11, collapsible coiling head 20 has been raised to the position as was shown in FIG. 5, making it ready to receive the cable to be wrapped.

Figure 12:
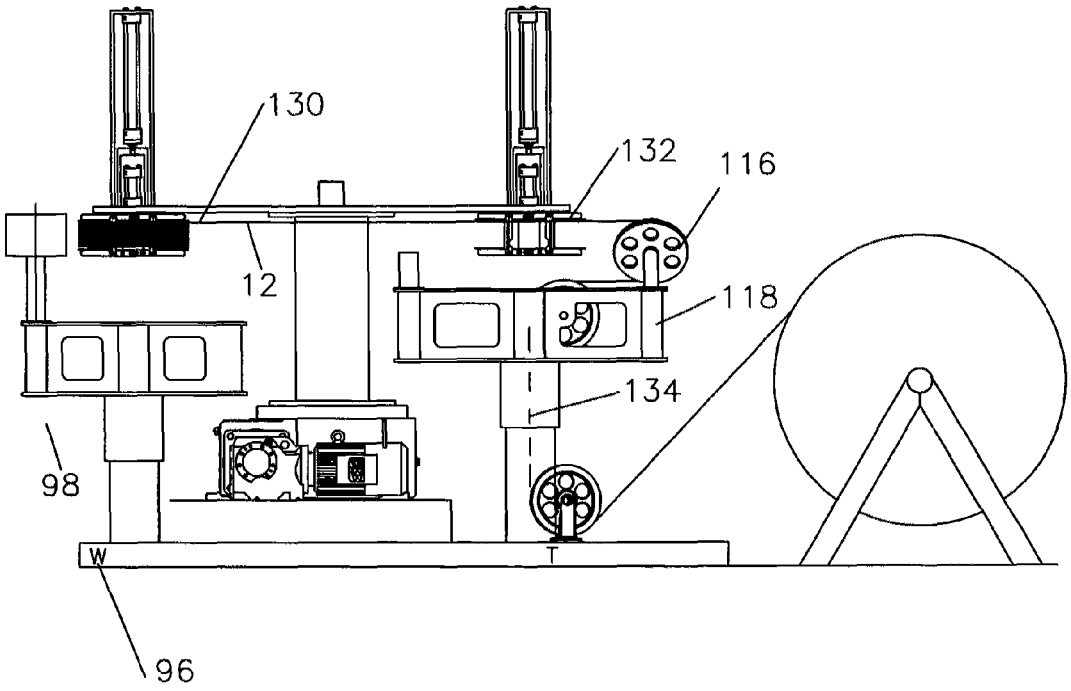
FIG. 12 is a view along arrows "5-5" of FIG. 7 showing the wrap at the twisting station about to begin.

Referring now to FIG. 12, the view has changed to the view as indicated by arrows "5-5" of FIG. 7. On the left side of the figure as is indicated by weld letter 96, a full wrap of cable is shown with the end of the cable 12 at 130 still being attached. Sheave 116 is positioned to start the wrap of the cable at the upper side 132 of the available space. As can be appreciated, when the flyer 118 makes one full rotation, the portion of cable 12 at 134 receives one full twist.

Figure 13:
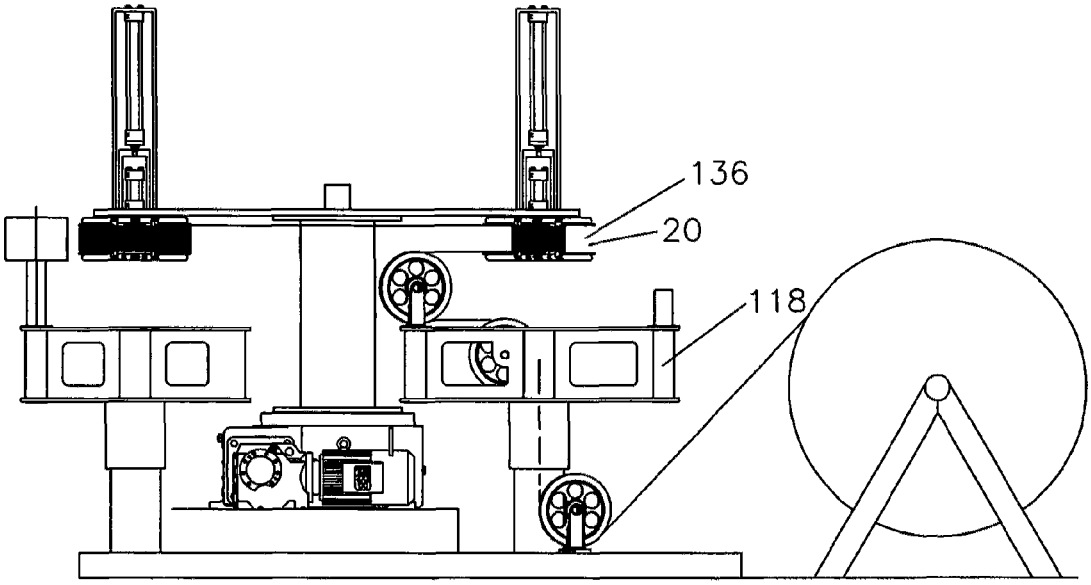
FIG. 13 is a view similar to FIG. 12 with the first wrap layer completed.

Referring now to FIG. 13, flyer 118 has been progressively lowered by a drive within flyer 118 (not shown) until a full first wrap of cable 136 is laid on the collapsible coiling head 20.

Figure 14:
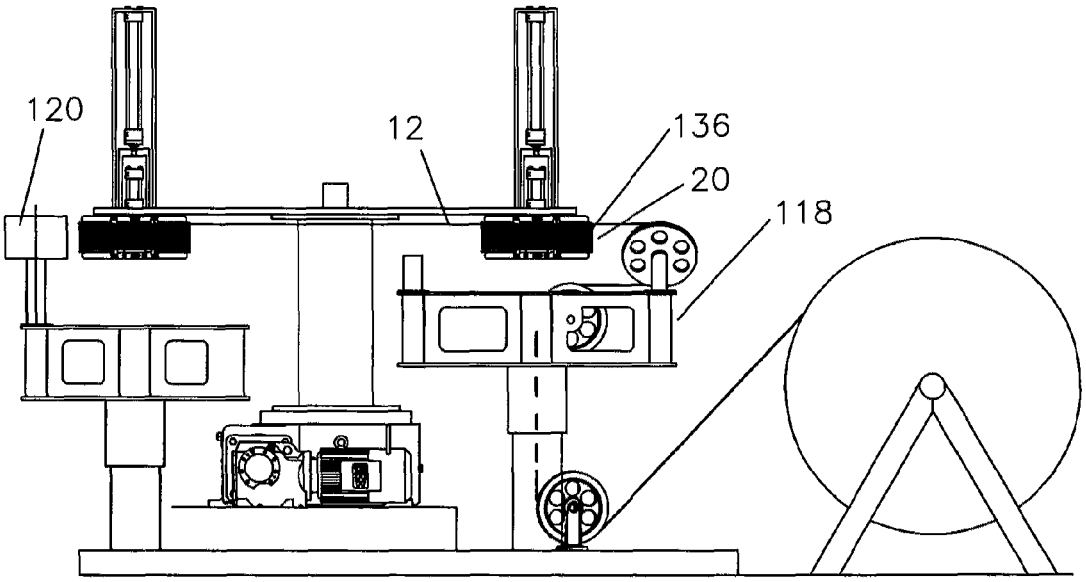
FIG. 14 is a view similar to FIG. 13 with the wrap completed.

Referring now to FIG. 14, flyer 118 has rotated around the collapsible coiling head 20 and reciprocated up and down until a full wrap of cable 12 is completed. Clearance dictates that it is appropriate for the wrap to start and finish at the upper end of space 136. As the cable 12 is wrapped at the station on the right side of this figure, the wrapping for the cable previously wrapped on the collapsible coiling head on the left is wrapped with wrapping material 120.

Figure 15:
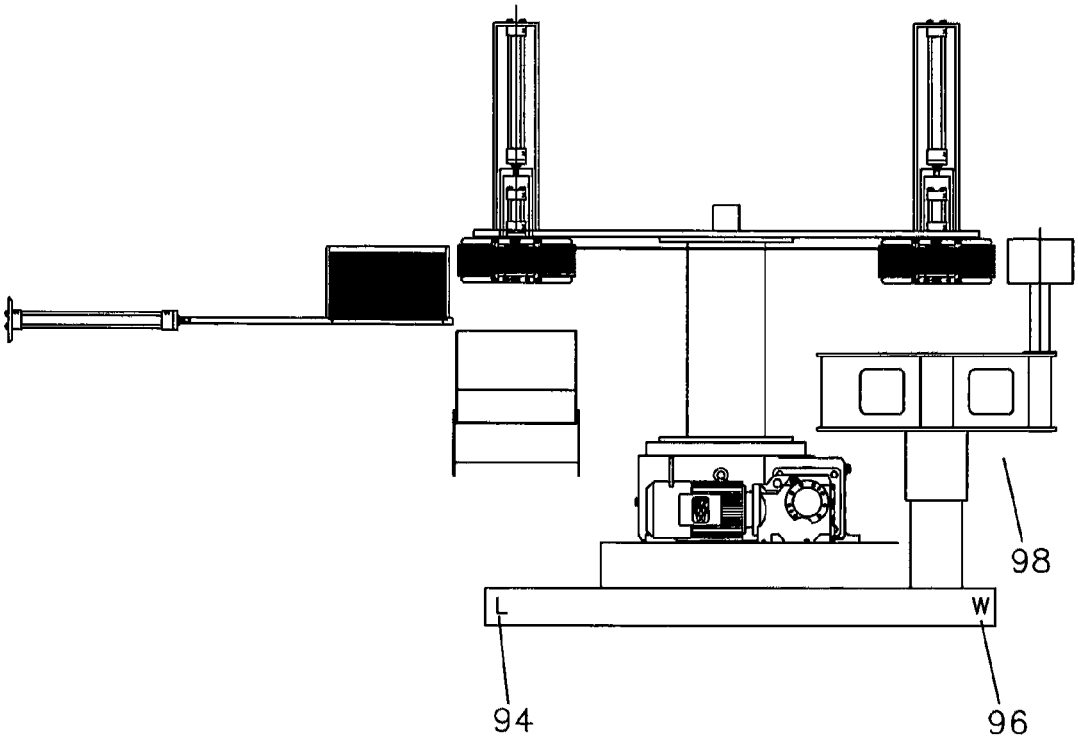
FIG. 15 is a view along arrows "4-4" of FIG. 7 showing completed wraps in the wrapping and loading stations.

Referring now to FIG. 15, the view has changed back to the view as indicated by arrows "4-4" of FIG. 7. The collapsible coiling head which was wrapped in FIG. 14 is now advanced to the wrapping station 98 as indicated by weld letter 96 and the collapsible coiling head which was at the wrapping station in FIG. 14 is now advanced to the station as indicated by the weld letter 94, or the starting station in FIG. 9.

Figure 16:
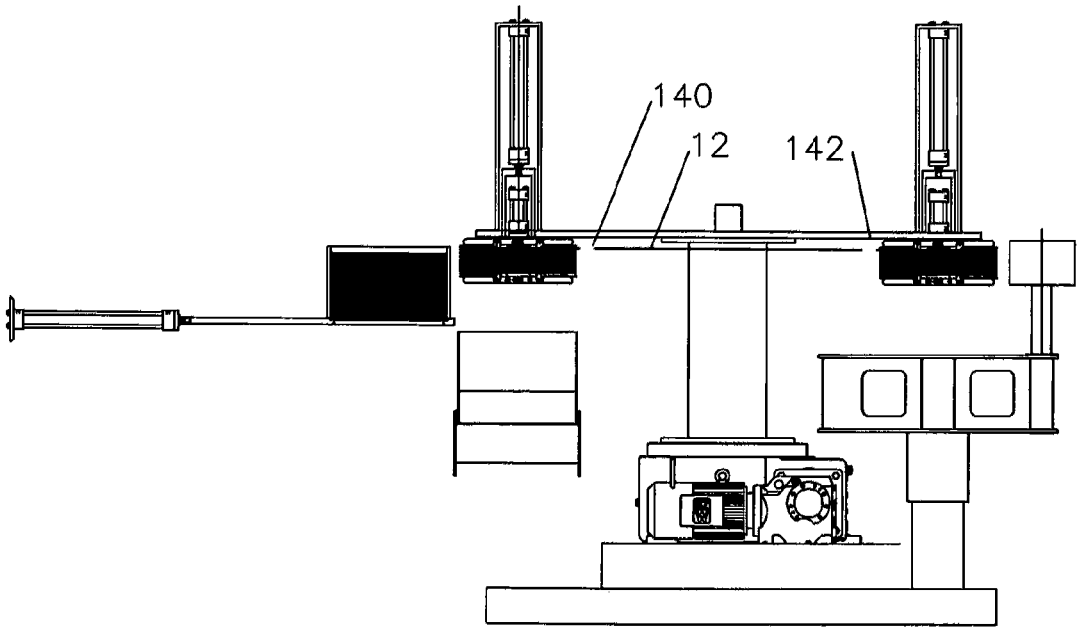
FIG. 16 is a view similar to FIG. 15 showing the cable being cut to separate the two wrapped bundles.

Referring now to FIG. 16, cable 12 is cut at locations 140 and 142.

Figure 17:
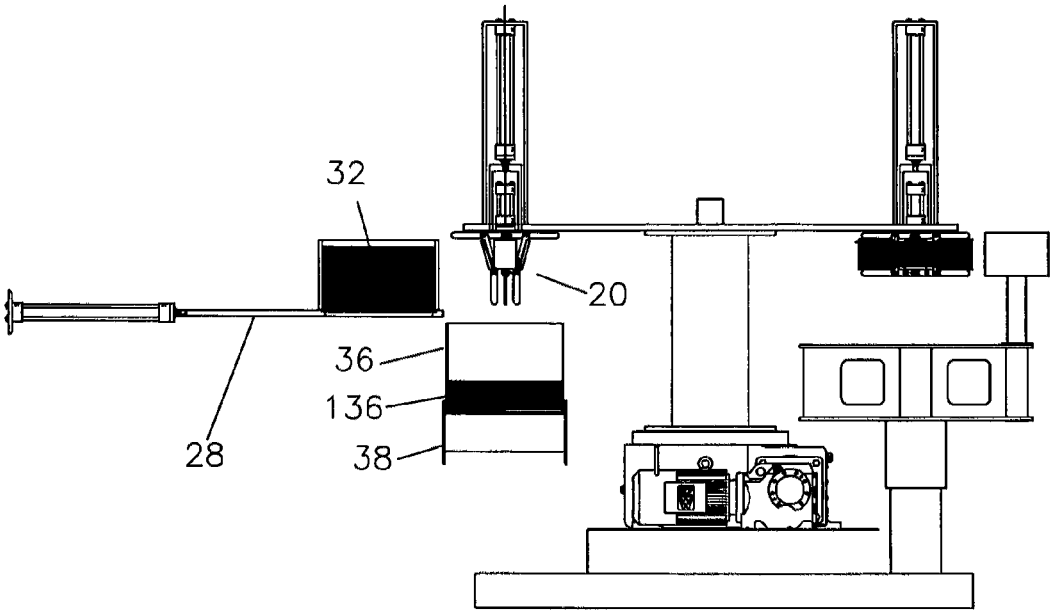
FIG. 17 is a view similar to FIG. 16 showing the collapsible coiling head at the loading station disengaged to drop the completed coil into the shipping box.

Referring now to FIG. 17, the collapsible coiling head 20 is disengaged allowing the wrapped full coil of cable 136 to drop into the shipping box 36 and be moved down the conveyor belt 38 for closing and shipment. At this time the slider 28 is ready to be moved forward with a new set of side plates to repeat the process.

The particular embodiments disclosed above are illustrative only, as the invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular embodiments disclosed above may be altered or modified and all such variations are considered within the scope and spirit of the invention. Accordingly, the protection sought herein is as set forth in the claims below.

That which is claimed is:

1. The method of supplying non-twisted cable from a non-rotating container comprising:

supplying a cable to a first spool in a first position by supplying said cable to said first spool in a direction generally parallel to a centerline of said first spool and wrapping said cable around said first spool so that proximately one twist will be applied to said cable each time said cable is wrapped around said spool, transferring said first spool to a second position without cutting said cable, transferring a second spool to said first position, supplying said cable to said second spool in said first position by supplying said cable to said second spool in a direction generally parallel to a centerline of said second spool and wrapping said cable around said second spool so that proximately one twist will be applied to said cable each time said cable is wrapped around said second spool, transferring said first spool to a third position and transferring said second spool to said second position, cutting said cable between said second and third positions, delivering said cable from said third position to be packaged to a container, repeating the process for additional sections of cable to be placed in additional containers, and pulling said cable from the center of said container to untwist said cable as said cable is being removed from said container to neutralize said twist induced in said cable in during said wrapping.

2. The method of claim 1 further comprising wrapping said cable around said first or second spool by providing a guide which orbits around said first or second spool.

3. The method of claim 2, further comprising said guide is a sheave.

4. The method of claim 2 further comprising said moving said guide axially of the centerline of said first or second spool to control how said cable is wound on said first or second spool.

5. The method of claim 4, further comprising said guide is a sheave.

6. The method of claim 2 further comprising said moving said first or second spool axially along the centerline of said first or second spool to control how said cable is wound on said first or second spool.

7. The method of claim 1 further comprising said container is a box.

8. The method of claim 1 further comprising that when said first spool is in said second position, said cable is wrapped with a wrapping.

* * * * *